United States Patent [19]

Garganese

[11] 4,381,158

[45] Apr. 26, 1983

[54] WRITING INSTRUMENT

[75] Inventor: Richard S. Garganese, North Kingston, R.I.

[73] Assignee: Dino L. Garganese

[21] Appl. No.: 220,988

[22] Filed: Dec. 29, 1980

[51] Int. Cl.[3] ..... B43K 24/04

[52] U.S. Cl. ..... 401/111; 401/93

[58] Field of Search ..... 401/109–113, 401/82, 92, 93, 94, 65

[56] References Cited

U.S. PATENT DOCUMENTS

| | | | |
|---|---|---|---|
| 2,881,736 | 4/1959 | Zepelovitch | 401/112 |
| 2,899,931 | 8/1959 | Bross | 401/93 |
| 2,905,147 | 9/1959 | Johmann | 401/110 |
| 2,988,055 | 6/1961 | Platt | 401/112 |
| 3,147,740 | 9/1964 | Bross | 401/110 |
| 3,181,507 | 5/1965 | Dannebann | 401/112 |
| 3,230,934 | 1/1966 | Eriksson | 401/112 |
| 3,813,176 | 5/1974 | Kamo | 401/94 |
| 3,836,264 | 9/1974 | Saito et al. | 401/92 |
| 3,892,495 | 7/1975 | Narnse et al. | 401/93 |
| 4,270,870 | 6/1981 | Hashimoto et al. | 401/93 |

*Primary Examiner*—William Pieprz

*Attorney, Agent, or Firm*—Salter & Michaelson

[57] ABSTRACT

A writing instrument is disclosed that includes an operating mechanism for propelling and retracting the writing point of the instrument through the use of depressible pads that are located in the barrel of the instrument adjacent to the lower end thereof for convenient access to the forefinger and thumb of the user of the instrument.

4 Claims, 6 Drawing Figures

WRITING INSTRUMENT

BACKGROUND OF THE INVENTION

The present invention relates to a pen having a writing cartridge that is moved to and from a writing position by the operation of depressible pads that are located in the barrel of the pen.

Retractable ballpoint pens are in common use and the mechanisms for effecting the propelling of the writing cartridge into the writing position have taken various forms and structures. The usual kind of ballpoint pen having a propelling and retracting mechanism that has been utilized heretofore incorporates a clutch-type structure that includes a driver that when urged downwardly causes a latch actuating element to rotate, wherein teeth formed thereon are moved either into engagement with lugs or between the lugs so that the driver forces the latch to a lower position for effecting longitudinal movement of a writing cartridge to the writing position, or permits the writing cartridge to be retracted from the writing position to an inoperative position. One example of the retraction-protraction mechanism of this type is illustrated in the Johmann U.S. Pat. No. 2,905,147.

Although these prior known operating mechanisms for ballpoint pens that included cartridges were satisfactory for the purposes intended, the operation of these devices were restricted to operation thereof by movement of the user's thumb into contact with the uppermost end of the mechanism that protruded from the upper barrel portion of the pen. Since the operating mechanism was limited in this manner, the ornamental appearance of the pen was sacrificed and only lower-priced pens were normally made with this kind of an operating mechanism.

More expensive operating mechanisms as utilized in ballpoint pens known heretofore incorporated the twist-type mechanism that provided for twisting of the upper barrel portion of the pen to cause an inner mechanism to propel the writing cartridge to the writing position thereof or to retract the cartridge to the inactive position. This kind of ballpoint pen has found some favor in the trade, primarily because of the propelling and retracting mechanism was usually reliable in operation, and further because the operating mechanism was concealed entirely within the confines of the barrel of the pen. Although the prior known twist-type mechanism for propelling and retracting a ballpoint cartridge in the prior known pen constructions has been accepted by many in the trade, the operation of the mechanism not only required a special manipulation by the user that oftentimes required two hands to effect but the pen was relatively expensive, and consequently the twist-type actuating mechanisms for ballpoint pens have not been universally accepted by all users.

Some writing instruments have been constructed with a propelling mechanism that includes a side pad that is depressible to effect a propelling action of the writing point. However, these prior known mechanisms have all been limited to the feeding of a lead to a writing position, and include a clutch mechanism for this purpose. Examples of such prior known constructions are illustrated in the U.S. Pat. to Saadi, No. 1,518,822; Nelson, No. 1,716,354; Woelm, No. 1,866,072; Saito, No. 3,836,264; Naruse et al, No. 3,892,495; and Naruse et al, No. 3,883,253. As will be apparent from the description following hereinafter, the present invention provides for the propelling of a ballpoint cartridge to the writing position by the use of an operating mechanism that also utilizes depressible side pads; but this mechanism is unique in structure and conceptually different than those illustrated in the prior art patents referred to above.

The present invention overcomes the above described criticisms of the presently known ballpoint pen operating mechanism and provides a unique operating mechanism that is simple to operate and effective in the propelling and retracting of the writing cartridge in the use thereof and can be made relatively inexpensively.

SUMMARY OF THE INVENTION

The present invention relates to a writing instrument having a barrel defined by a tubular lower barrel portion and a tubular upper barrel portion removably mounted on the lower barrel portion. An elongated ink cartridge is located in the barrel and is provided with a writing point that is extendible through the lower end of the lower barrel portion. An operating means is located in the barrel and engages the rearmost end of the cartridge for alternately urging the cartridge downwardly and upwardly to propell the writing point through the lower end of the lower barrel portion and to retract the cartridge for moving the writing point to an inactive position. A pair of openings are formed in the lower barrel portion in opposed relation, and an actuating member is located in the lower barrel portion and underlies the openings. A driver member operatively engages the cartridge and is located adjacent to the actuating member in alignment with the openings, wherein an inward pressure exerted on the actuating member by a force directed through the openings by the thumb and forefinger of the user, causes the actuating member in cooperation with the operating means to exert a longitudinal force on the driver member to move the driver member and cartridge with which it is engaged in a longitudinal direction to either propel the writing point through the lower end of the lower barrel portion or to retract the writing point to the inactive position thereof.

Accordingly, it is an object of the present invention to provide a unique push-type of pen mechanism in which the writing end of the pen is propelled forwardly by the simple inward pressure of the user's forefinger and thumb on an actuating member that propels the pen cartridge to a writing position or retracts the cartridge to an inactive position.

Other objects, features and advantages of the invention shall become apparent as the description thereof proceeds when considered in connection with the accompanying illustrative drawings.

DESCRIPTION OF THE DRAWING

In the drawing which illustrates the best mode contemplated for carrying out the present invention.

DESCRIPTION OF THE INVENTION

Figures 1, 2, 3, 4, 5, 6:
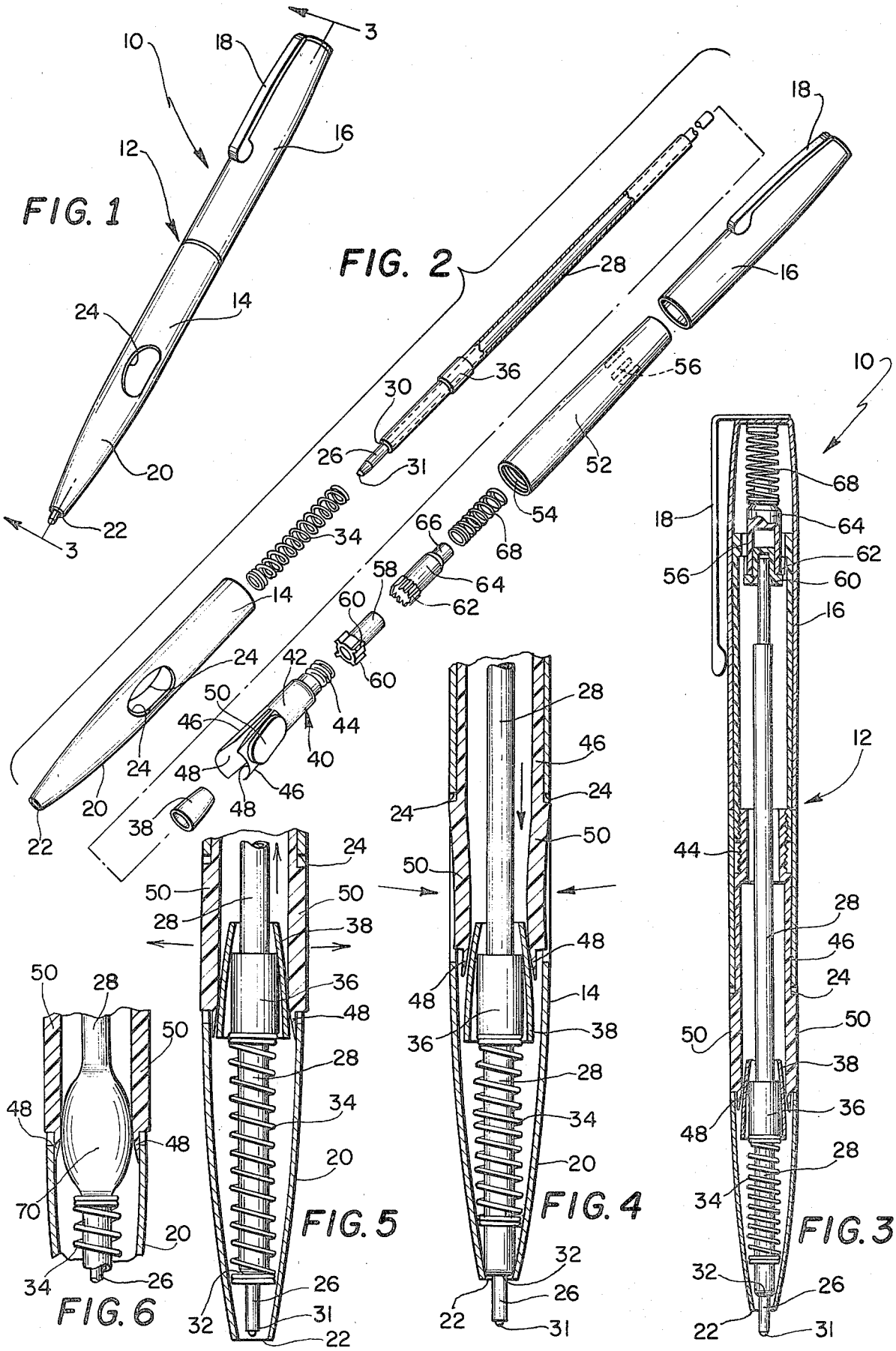
FIG. 1 is a perspective view of the writing instrument embodied in the present invention.
FIG. 2 is an exploded perspective view illustrating the component parts of the writing instrument embodied herein.
FIG. 3 is a vertical sectional view of the assembled pen illustrating the writing point of the pen cartridge in the propelled or writing position thereof.
FIG. 4 is an enlarged fragmentary sectional view of the lower portion of the writing instrument illustrating the manner in which the pen cartridge is retracted from the writing position.
FIG. 5 is a fragmentary sectional view similar to FIG. 4 and further illustrating the location of the component parts of the actuating means for retracting the writing instrument to the inactive position thereof.
FIG. 6 is a fragmentary sectional view illustrating an alternate form of driver member that is engageable by the actuating member for propelling and retracting the pen cartridge.

Referring now to the drawing, and particularly to FIGS. 1 and 2, the writing instrument embodied in the present invention is illustrated and is generally indicated at 10. As shown, the writing instrument 10 includes a barrel generally indicated at 12 that is defined by a lower barrel portion 14 and a cap or upper barrel portion 16 on which a conventional clip 18 is mounted. The lower barrel portion has a tapered lower end 20 which is formed with the usual configuration and is open at the lowermost end thereof as indicated at 22. Oval-shaped openings 24 are also formed in the lower barrel portion 14, the openings 24 being disposed in opposed relation as illustrated in FIGS. 3 and 4 and also being located such that they are accessible by the thumb and forefinger of the user of the writing instrument as will be described hereinafter.

Referring now to FIGS. 2 through 5 in particular, the operating mechanism for propelling and repelling a ballpoint pen cartridge indicated at 26 to and from the writing position thereof is illustrated. The cartridge 26 is received in an elongated sleeve 28, the lowermost end of which terminates in a shoulder 30. The cartridge 26 extends through the elongated sleeve 28, a writing point 31 of the cartridge being spaced below the shoulder 30. Formed as an integral part of the elongated sleeve 28 and spaced upwardly from the shoulder 30 is an enlarged portion 36 that receives a tubular driver member 38 thereon that is formed in a tapered configuration, the purpose of which will be described hereinafter.

Located interiorly of the lower barrel portion 14 is an actuating member generally indicated at 40 which as shown in FIG. 2 includes a tubular body portion 42 that has an upper reduced threaded neck section 44 formed thereon. Joined to the tubular body portion 42 and extending therebelow are split legs 46, the inner surfaces of which are tapered or inclined as indicated at 48, the inclination of the inner surfaces of the legs 46 corresponding to the taper as formed on the driver member 38. Fixed exteriorly to the legs 46 of the tubular body portion 40 are pads 50 that have a substantial oval configuration and that are shaped and dimensioned for being received in the openings 24 as formed in the lower barrel portion 14. It is seen that the pads 50 are externally accessible through the openings 24, and upon the application of an external force thereto by the thumb and forefinger of the user, the legs 46 of the actuating member 40 are depressed inwardly to urge the inner tapered surfaces 48 of the legs 46 against the driver member 38, which forces the driver member downwardly carrying the enlarged portion 36 and the cartridge 26 therewith.

As shown more clearly in FIG. 2, a sleeve 52 having an interiorly lower threaded portion 54 formed therein for engagement with the threaded neck section 44 of the actuating member 40, is located within the upper barrel portion 16. As further illustrated in FIG. 3, the sleeve 52 is received within the upper barrel portion or cap 16 in the assembled position of the pen. Formed interiorly of the sleeve 52 adjacent to the upper end thereof are a series of grooves and lugs indicated in phantom at 56 in FIG. 2, the lugs and grooves 56 defining a part of an actuating mechanism that cooperates with the actuating member 40 to provide for the propelling movement of cartridge 26. Engaging the lugs and grooves 56 is a tubular member 58 on the lowermost end of which a plurality of outwardly extending ribs 60 are formed. A toothed wheel 62 formed on the lowermost end of a tubular member 64 operatively engages the ribs 60 and is formed with an upper reduced portion 66 that projects interiorly of an upper spring 68. As more clearly illustrated in FIG. 3, the upper spring 68 is located at the uppermost interior portion of the upper barrel portion 60 and exerts a downward force on the cartridge 26 when the component parts of the pen are fully assembled, the upper end of the cartridge 26 projecting into the bore of the tubular member 58 and terminating therein. The tubular members 58 and 64 and the operation thereof in connection with the lugs and grooves 56 for producing a longitudinal movement of the cartridge 26 are conventional and form no part of the present invention. However, the operation of this mechanism which is produced by the longitudinal movement of the elongated sleeve 28 and the cartridge 26 in response to an inward force directed against the pads 50 by the user, causes the elongated sleeve to move downwardly in the lower barrel portion 14 until the shoulder strikes the reduced lower end of the tapered portion 20. The writing end 31 of the cartridge is then propelled through the opening 22 and into the writing position. As will be described, the lower spring 30 is calibrated to be somewhat stronger than the upper spring 68 so as to locate the cartridge 26 in a normally upper inactive position, the spring 68 being compressed in this position. Thus, the upper spring 68 acts to exert a downward force on the propelling mechanism as defined by the tubular members 56, 58 and 64 when the cartridge 26 is moved in a longitudinal direction to either the writing or inoperative positions thereof.

In use of the writing instrument 10 and with the component parts thereof assembled as illustrated in FIG. 3, and assuming that the cartridge 26 is disposed in the inoperative position so as to locate the writing point 31 interiorly of the lower end of the lower barrel portion 14, the user propels the cartridge 26 to the writing position by exerting a force on the pads 50 by depressing his thumb and forefinger thereon. As an external force is applied to the pads 50 by the user, the tapered configuration of the driver member 38 in response to the downwardly directed pressure of the legs 46 of the actuating member 40 causes the driver member 38 to move downwardly to the position shown in FIG. 4, wherein the cartridge 26 and the elongated sleeve 28 are urged downwardly until the shoulder 32 thereof bears against the adjacent interior wall of the tapered portion 20. As the cartridge 26 is moved downwardly, the member 64 is rotated upon engagement thereof with the ribs 60 and within the lugs and projections 56 as formed in the sleeve 52 to a downwardly located position. The cartridge 26 is thus moved to the lower position as shown in FIG. 4, and thereafter upon release of the pads 50, the spring 34 which is slightly stronger than the spring 68 urges the cartridge 26 rearwardly, which now slightly retracts to the position illustrated in FIG. 3. The cartridge is now located in the writing position, with the writing point 31 thereof exposed.

When it is desired to retract the cartridge to the inoperative position thereof, the pads 50 are again depressed by the thumb and forefinger of the user, the inward movement of the pads again urging the driver member 38 downwardly against the action of the spring 34. The members 58 and 64 are again rotated relative to the lugs and projections 56 to enable the ribs 60 to move off of a lug 56 and into one of the grooves adjacent thereto, wherein the cartridge 26 is urged to its original inoperative position as shown in FIG. 5.

Referring now to FIG. 6, a modified form of the invention is illustrated, wherein a driver member that is indicated at 70 is formed in a one-piece construction for securement to an elongated sleeve that receives the cartridge 26. The driver member 70 is also formed with a bulbous configuration, the external surface of which is curved to correspond to the tapered configuration of the driver member 38. Although not shown, the driver member 70 can also be formed in a tear drop shape for satisfying the requirement for being responsive to movement of the sleeve 28.

It is understood that the pads 50 as shown in FIG. 6 are urged inwardly to force the tapered surfaces 48 joined thereto against the driver member 70 to urge it downwardly against the action of the spring 34 in the manner as described hereinabove.

It is seen that the operation of the propelling and repelling mechanism as described and illustrated provides for a simple yet effective means for moving the cartridge 26 to an operative and inoperative position thereof. It is only necessary for the user to depress the pads inwardly by his thumb and forefinger to move the writing point to the writing position. The writing point 30 is retracted by again urging the pads 50 inwardly, which movement is easily effected by the user with the pen located in one hand and the thumb and forefinger of that hand located on the pads as hereinabove described.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A writing instrument, comprising a rigid barrel defined by a rigid tubular lower barrel portion having an open lower end and a rigid tubular upper barrel portion removably mounted on said lower barrel portion and having a closed upper end, a rigid elongated ink cartridge located in said barrel and having a writing point that is extendible through the open lower end of said lower barrel portion, operating means located in said barrel for alternately urging said cartridge downwardly and upwardly to propel the writing point through the open end of said lower barrel portion to an exposed writing position thereof and to retract said cartridge for moving the writing point to an inactive position thereof, wherein said writing point is withdrawn within the open lower end of said lower barrel portion, a pair of openings formed in said lower barrel portion in opposed relation, said operating means including an actuating member located in said lower barrel portion and underlying said openings therein, said actuating member having a pair of opposed arms which are rearwardly tapered on the inner surfaces thereof, and a rearwardly tapered rigid driver member rigidly connected to said cartridge and located adjacent to said actuating member in alignment with said openings, the rearward tapers of the inner surfaces of said arms corresponding to the tapered configuration of said driver member, wherein an inward pressure on said actuating member by a force directed thereto through said openings causes relative sliding movement between said actuating member and said driver member with the inner surfaces of said actuating member traveling along the outer surface of said driver member as a result of the tapered configurations thereof to thereby cause said actuating member in cooperation with said operating means to exert a longitudinal force on said driver member to move said driver member and said cartridge with which it is interengaged in a longitudinal direction to cause direct positive movement of the writing point of said instrument through the open end of said lower barrel portion to the exposed writing position thereof, or to retract the writing point to the inactive position thereof, said actuating member having an upper tubular portion to which are joined said downwardly extending opposed arms on the outer surfaces of which pads are located, said arms being free at the lower ends thereof and having flexing movement relative to said upper tubular portion, and said pads being received in the openings in said lower barrel portion, wherein an inward force on said pads causes said arms to flex inwardly against said tapered driver member to force the driver member in the longitudinal direction thereof.

2. A writing instrument as claimed in claim 1, said operating means including an operating assembly that alternately locates said cartridge in a downward writing position and an upward inactive position, and a spring for normally urging said cartridge to the downward writing position thereof.

3. A writing instrument as claimed in claim 2, an elongated sleeve on which drive member is mounted and receiving said cartridge therein, a second spring located in said lower barrel portion in encircling relation on said elongated sleeve and engaging said elongated sleeve at the underside of said tapered drive member, said second spring normally maintaining said elongated sleeve and said cartridge in the upward inactive position.

4. A writing instrument as claimed in claim 3, said second-named spring being stronger than said first-named spring so that upon release of the operating assembly following a downward longitudinal movement of said elongated sleeve and said cartridge, said first-named spring will urge the cartridge to the downward writing position.

* * * * *